US006454544B2

(12) United States Patent
Palesch et al.

(10) Patent No.: US 6,454,544 B2
(45) Date of Patent: Sep. 24, 2002

(54) PUMP FOR CONVEYING FUEL IN AN INTERNAL COMBUSTION ENGINE

(75) Inventors: Edwin Palesch, Lenningen; Gerold Sluka, Neckartailfingen; Ralf Naumann, Crimmitschau, all of (DE)

(73) Assignee: Hydraulik-Ring GmbH, Nürtingen (DE)

( * ) Notice: Subject to any disclaimer, the term of this patent is extended or adjusted under 35 U.S.C. 154(b) by 0 days.

(21) Appl. No.: 09/739,544

(22) Filed: Dec. 18, 2000

(30) Foreign Application Priority Data

Dec. 20, 1999 (DE) ..... 199 61 558

(51) Int. Cl.[7] ..... F04B 1/06

(52) U.S. Cl. ..... 417/221; 417/212; 74/25; 74/570

(58) Field of Search ..... 417/212, 219, 417/220, 221; 418/29; 74/10.52, 24, 570, 571 R, 571 L, 571 M, 25, 44, 49

(56) References Cited

U.S. PATENT DOCUMENTS

| | | | | |
|---|---|---|---|---|
| 852,033 A | * | 4/1907 | Philippe | |
| 2,223,100 A | * | 11/1940 | Foster | 74/52 |
| 2,513,514 A | * | 7/1950 | Poage | 74/50 |
| 2,592,237 A | * | 4/1952 | Bradley | 74/571 |
| 2,815,670 A | * | 12/1957 | Jorgensen | 74/199 |
| 4,078,439 A | * | 3/1978 | Iturriaga-Notario | 74/53 |
| 4,245,966 A | * | 1/1981 | Riffe | 417/539 |
| 4,642,839 A | * | 2/1987 | Urban | 15/256.53 |
| 5,163,336 A | * | 11/1992 | Biondetti | 74/61 |
| 5,163,884 A | * | 11/1992 | Takamiya et al. | 475/215 |

* cited by examiner

*Primary Examiner*—Charles G. Freay
*Assistant Examiner*—Han Lieh Liu
(74) *Attorney, Agent, or Firm*—Gudrun E. Huckett

(57) ABSTRACT

A pump for conveying a liquid has a housing and a shaft rotatably supported in the housing. An eccentric drive is arranged in the housing. At least one drive element is provided and is configured to be driven by the eccentric drive. The shaft is configured to adjust the eccentricity of the eccentric drive. The drive element is configured to be adjusted according to the eccentricity of the eccentric drive by a translatory movement in a direction transverse to the shaft.

27 Claims, 2 Drawing Sheets

PUMP FOR CONVEYING FUEL IN AN INTERNAL COMBUSTION ENGINE

BACKGROUND OF THE INVENTION

1. Field of the Invention

The invention relates to a pump, in particular, for pumping fuel in an internal combustion engine of a motor vehicle, the pump comprising a housing in which a shaft is rotatably supported.

2. Description of the Related Art

Conveying pumps are known which continuously convey fuel, in particular, diesel fuel, from a tank into a reservoir. The cylinders of the internal combustion engine are connected to the reservoir by solenoid valves. The greater portion of the fuel is returned from the reservoir into the tank by means of pressure limiting valves because only a small portion of the continuously conveyed fuel is required for the internal combustion process in the cylinders. The continuous return of the fuel results in unsatisfactory efficiency. As a result of the continuous conveying and return action, a great heat development is also observed. Accordingly, it is not possible to employ a plastic material for such a pump; it is necessary to employ metal which is more expensive.

For conveying the fuel it is also known to provide a vacuum throttle. Check valves ensure that a sufficient amount of fuel is always available for the combustion process. The check valves or their springs have however tolerances so that different amounts of fuel will enter the cylinders. As a result of the variable degree of filling, high pulsations occur which result in a strong noise development. Also, the mechanical loading of the motor cylinders and their pistons is very high. In order to maintain a relatively small amount of fuel in circulation, proportional solenoid valves are adjusted to a middle position so that only a portion of the fuel is conveyed. As a result of tolerances of the springs of the proportional solenoid valves, different amounts of fuel are present in the piston chamber. During the vacuum process vapor bubbles are formed in the piston chamber which are quickly compressed upon return of the piston. However, since fuel cannot be compressed, the piston is thus greatly slowed down so that this results in high mechanical loading. By means of the proportional solenoid valves, it is possible to supply per time unit the same amount of fuel, respectively. However, since the amount of fuel for the internal combustion process depends on the engine speed (rpm) of the motor, the proportional solenoid valves must be controlled in a complicated fashion as a function of the rpm of the motor.

SUMMARY OF THE INVENTION

It is an object of the present invention to configure the pump of the aforementioned kind such that it has a good efficiency and conveys reliably the amount of fuel required for the internal combustion process.

In accordance with the present invention, this is achieved in that the eccentricity of an eccentric drive can be adjusted by means of the shaft, wherein the eccentric drive is provided for driving at least one drive element which is adjustable according to the adjusted eccentricity by a translatory movement in a plane positioned transverse to the shaft.

In the pump according to the invention, the drive element is driven by means of the eccentric drive. Depending on the eccentricity of the eccentric drive, the drive element is moved or adjusted by a translatory movement to varying degrees in a plane positioned transversely to the shaft. With this measure, it is, for example, possible to adjust in a continuous manner the stroke of a piston from zero to a maximum value by means of the drive element, for example, in order to convey a corresponding amount of fuel into the internal combustion chamber of the motor cylinder. Since the eccentric drive is coupled with the shaft, the eccentricity can be adjusted in a simple way as a function of the rpm of the internal combustion engine. The eccentric drive makes possible a compact configuration of the pump. It is suitable especially for common rail systems.

DESCRIPTION OF THE PREFERRED EMBODIMENTS

Figure 2:
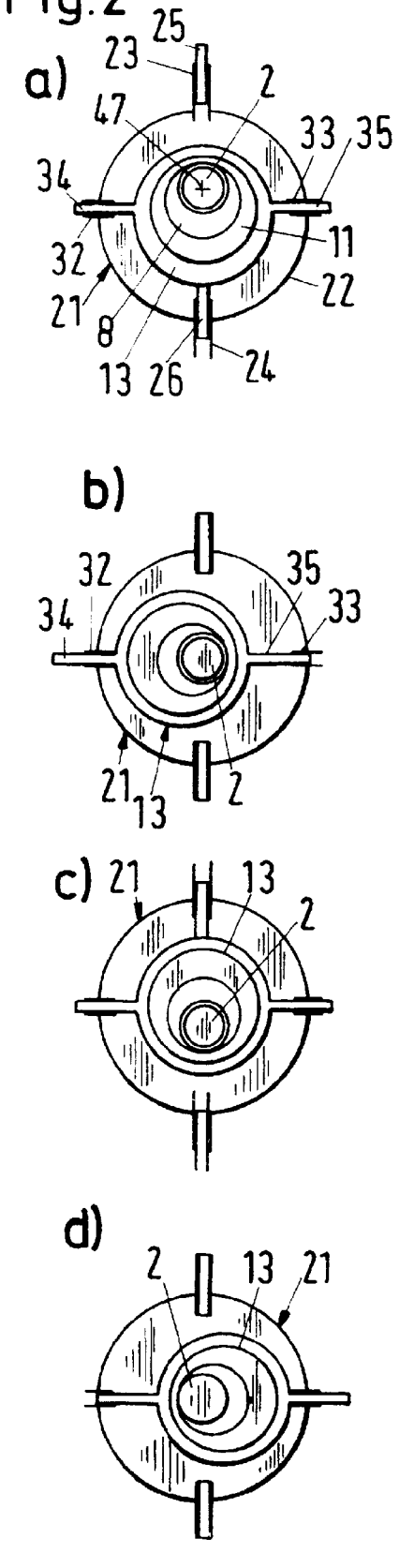
FIG. 2*a* shows in a simplified and schematic illustration a first position of a drive element of the pump according to the invention for actuating pistons.
FIG. 2*b* shows in a simplified and schematic illustration a second position of the drive element of the pump according to the invention for actuating pistons.
FIG. 2*c* shows in a simplified and schematic illustration a third position of the drive element of the pump according to the invention for actuating pistons.
FIG. 2*d* shows in a simplified and schematic illustration a fourth position of the drive element of the pump according to the invention for actuating pistons.

The pump according to the invention is preferably employed in common rail systems as they are used in motor vehicles for conveying fuel, in particular, diesel fuel. By changing the stroke of the piston, the amount of fuel to be injected can be varied.

The pump can also be used in other areas, for example, in the field of high-pressure technology, water jet cutting technology, high pressure hydroforming, clamping technology, machine tools and the like.

The pump has a housing 1 (FIG. 1) which is penetrated by a rotatably driven shaft 2. In the vicinity of the bottom 3 of the housing 1, a rotor 4 is fixedly mounted on the shaft 2. It comprises at least two blades 5 which are positioned diametrically opposite one another and extend radially. The rotor 4 is surrounded by a stator 6 which is supported on the shaft 2 so as to be rotatable relative to the rotor 4. The stator 6 is penetrated by the shaft 2 and has two chambers which are separated from one another by a transverse stay into which a rotor blade 5 extends, respectively. The rotor 4 with the stator 6 form an adjusting device of the "Schwenkflugel" type (variable geometry or variable swap type) which is known and is therefore not explained in detail in this connection. The stator interior is divided by the transverse stay into two chambers into which the rotor blades 5 project. Each rotor blade 5 divides the stator chamber into two portions. Hydraulic medium is supplied via the shaft 2 in a manner known in the art to each chamber portion, receptively, of the two chambers. In this way, a relative rotation between the rotor 4 as the adjusting element and the stator 6 can be performed.

Figure 3:
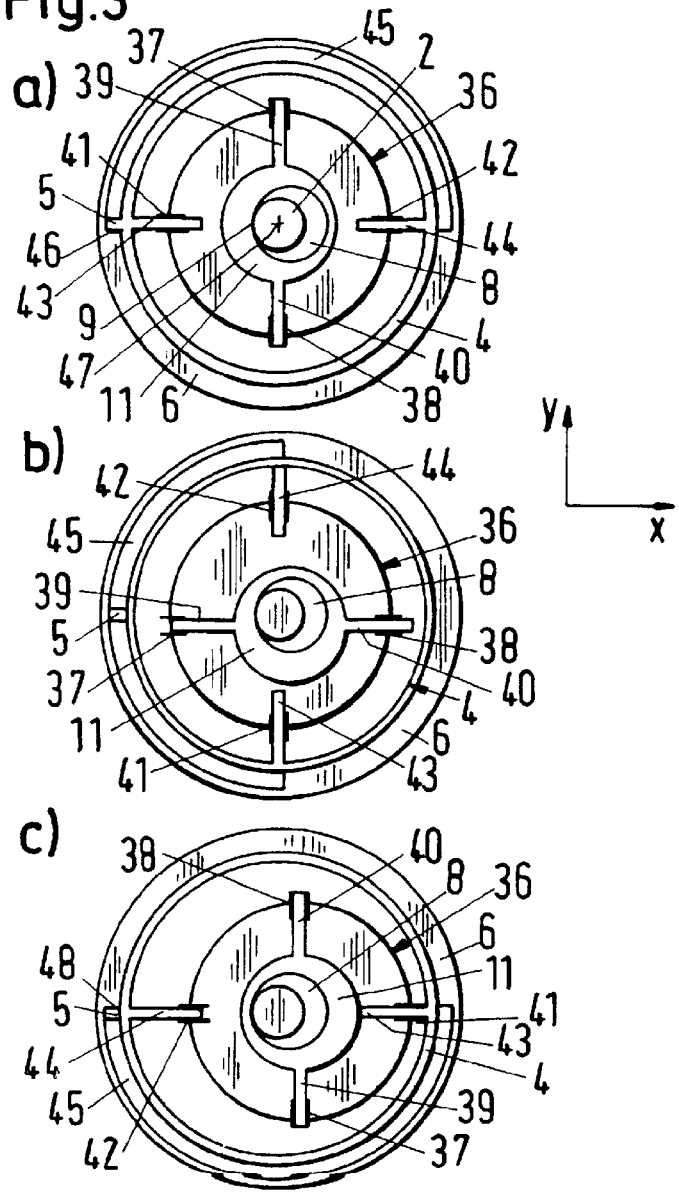
FIG. 3*a* shows in a simplified and schematic illustration a first position of a coupling member of the pump according to the invention.
FIG. 3*b* shows in a simplified and schematic illustration a second position of the coupling member of the pump according to the invention.
FIG. 3*c* shows in a simplified and schematic illustration a third position of the coupling member of the pump according to the invention.

In the area adjacent to the adjusting device 7, the shaft 2 is provided with an inner eccentric 8 which is advantageously formed as a unitary (monolithic) part of the shaft 2. The inner eccentric 8 is arranged relative to the shaft 2 such that the eccentric 8 and the shaft 2 have a common tangent at one location 9 (FIG. 3*a*).

Figure 1:
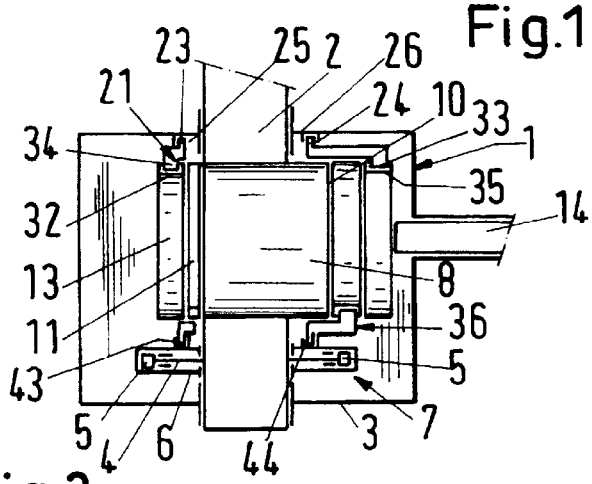
FIG. 1 shows in a side view and in a simplified illustration the pump according to the present invention.
Figure 4:
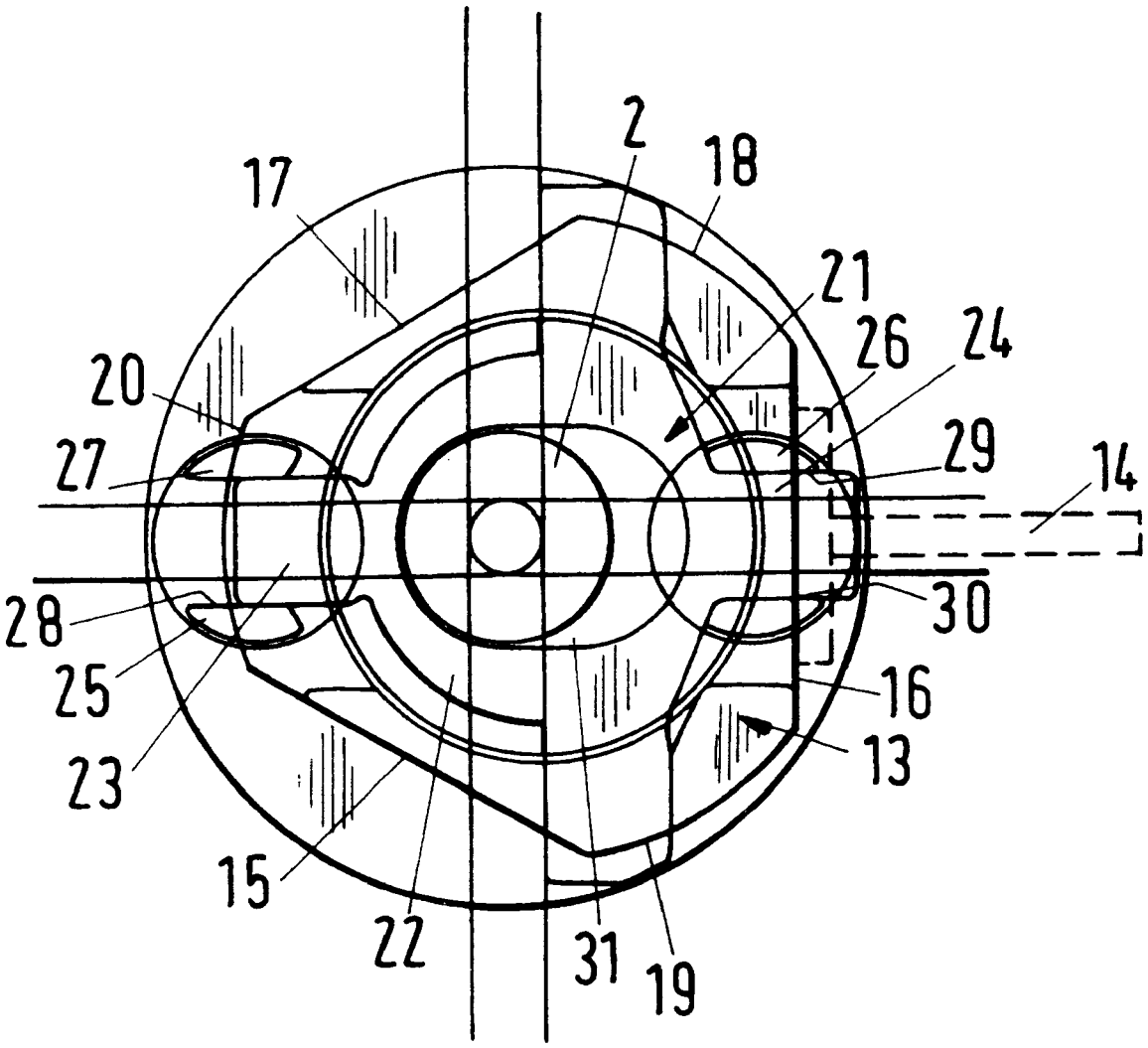
FIG. 4 is a plan view onto the pump according to the invention.

An external eccentric 11 is seated on the inner eccentric 8 with interposition of a bearing 10 (FIG. 1). The external eccentric 11 advantageously has the same axial length as the inner eccentric 8. The external eccentric 11 is surrounded with interposition of a bearing 12 by a drive element 13 (FIGS. 1 and 2). In FIG. 2, the drive element 13 (slotted link or connecting link) is illustrated as a circular ring in order to simplify the drawing. As is illustrated in FIG. 4, the drive element 13 has substantially a triangular contour. According to the number of the pistons 14 to be actuated, the drive element 13 is provided at its circumference with planar surfaces 15 to 17 (FIG. 4) against which the pistons 14 rest. In the illustrated embodiment, the drive element 13 is provided with three such surfaces 15 to 17, with a piston 14 resting against each surface 15–17, respectively. In FIG. 4, only one piston 14 is illustrated in order to simplify the drawing. The planar surfaces 15 to 17 are connected to one another by curved surfaces 18 to 20 which are positioned on a common circular arc or cylinder mantle.

The drive element 13 is guided by means of at least one coupling member 21 in the housing 1. As illustrated in an exemplary fashion in FIG. 4, the coupling member 21 has an annular part 22 which is seated external to the inner eccentric 8 on the shaft 2 and from which two arms 23, 24 project radially diametrically. The arms 23–24 are counter guide parts that engage the guides 25 and 26 provided on the housing. As illustrated in FIG. 4, the arms 23, 24 of the coupling member 21 have parallel extending longitudinal sides 27, 28; 29, 30 which extend in the radial direction and with which they are guided in the radial direction on counter surfaces of the guides 25, 26 on the housing 1. The guides 25, 26 are arranged such and the arms 23, 24 have such a length that the arms 23, 24 are securely guided on the guides 25, 26 in any displacement position of the coupling member 21. In order for the coupling member 21 to be moved in the longitudinal direction of the arms 23, 24 relative to the shaft 2, the annular part 22 of the coupling member 21 is provided with a corresponding slotted hole 31. Its width matches the diameter of the shaft 2.

As illustrated in FIG. 2*a*, the arms 23, 24 can also be of a fork-shaped design so that they surround the guides 25, 26 provided on the housing 1.

The coupling member 21 is provided with guides 32, 33 (FIG. 2) which also extend diametrically relative to one another and have an angular spacing of 90° to the guides 25, 26. The guides 32, 33 are provided for guiding the counter guide parts 34, 35 which are provided on the drive element 13. The guides 25, 26 and 32, 33 can be positioned in a common radial plane of the shaft 2 but also in radial planes of the shaft 2 that are axially spaced from one another. As a result of guiding of the drive element 13 in the coupling member 21, which, in turn, is guided in the housing 1, it is ensured that the drive element 13 does not perform a rotational movement upon rotation of the shaft 2 but is moved by a translatory movement transverse to the shaft 2. This will be explained in more detail with the aid of FIGS. 2*a* to 2*c*.

The coupling member 21 is positioned on one side of the two eccentrics 8, 11. On the oppositely located side of the eccentrics 8, 11 a further coupling member 36 is provided with which the external eccentric 11 is coupled with the stator 6. The coupling member 36 is seated on the shaft 2 and has diametrically oppositely positioned guides 37, 38 with which counter guide parts 39, 40 of the external eccentric 11 can be radially guided. The coupling member 36 is furthermore provided with two diametrically oppositely positioned guides 41, 42 which have an angular spacing of 90°, respectively, relative to the guides 37, 38 and by which counter guide parts 43, 44 of the stator 6 are radially guided. The coupling member 36 can be moved in the same way as the coupling member 21 in a radial plane relative to the shaft 2. In order to make this displacement movement possible, the coupling member 36 is provided with a slotted hole (not illustrated) whose width corresponds to the diameter of the shaft 2.

By relative movement of the two eccentrics 8 and 11 by means of the adjusting device 7, the eccentricity of the drive element 13 can be adjusted continuously. The greater the eccentricity, the greater the stroke of the pistons 14. When moved, the drive element 13 transmits the adjusted eccentricity onto the piston 14. Each piston 14 is loaded by a pressure spring (not illustrated) in the direction of contacting (resting against) the drive element 13. The spring force is only of such magnitude that the piston 14 rests properly and safely at the planar sides 15 to 17 of the piston 14.

In order to adjust the two eccentrics 8 and 11 relative to one another, the hydraulic medium is introduced such into the adjusting device 7 that the relative rotational position between the rotor 4 and the stator 6 is changed in the required amount. In FIGS. 3*a* to 3*c*, one of the rotor blades 5 which engages the chamber 45 of the stator 6 is schematically illustrated. In the position according to FIG. 3*a*, the rotor blade 5 rests against an end wall 46 of the stator chamber 45. In this case, the external eccentric 11 is rotated relative to the inner eccentric 8 such that the coupling member 36 has a central position relative to the axis 47 of the shaft 2. When the shaft 2 is driven in rotation, the coupling member 36 is thus not reciprocated.

In the position according to FIG. 3*b*, the stator 6 is rotated relative to the rotor 4 so that the rotor blade 5 now is in the central position within the stator chamber 45. With this relative rotation between the rotor 4 and the stator 6, the external eccentric 11 is rotated by means of the coupling member 36 relative to the inner eccentric 8 and, in this way, a certain eccentricity of the eccentric drive is adjusted. As a result of the relative rotation of the rotor 4 relative to the stator 6, the coupling member 36 is entrained by a corresponding amount by means of the counter guide parts 43, 44 of the rotor 4 and the guides 41, 42 of the coupling member 36. When comparing FIGS. 3*a* and 3*b*, it becomes clear that the coupling member 36 is moved in the X direction by this rotation. When the shaft 2 in this intermediate position is rotated about its axis 47, the coupling member 36 carries out a reciprocating movement in the X–Y plane as a function of the eccentric movement of the two eccentrics 8, 11. Since the drive element 13 is seated on the eccentric 11, the drive element 13 is also reciprocated according to the eccentricity in the X–Y plane. As a result, the pistons 14 are actuated via the planar surfaces 15 to 17. Accordingly, they carry out a certain stroke based on the adjusted eccentricity. Since in the illustrated embodiment the rotor 4 has been rotated relative to the stator 6 by 90° and the stator chamber 45 extends about an angular range of 180°, half the stroke of the piston 14 is generated in the position according to FIG. 3*b*.

As is illustrated in an exemplary manner in FIG. 3*c*, it is also possible to rotate, the stator 6 and the rotor 4 relative to one another such that the rotor blade 5 will come to rests against the oppositely positioned end wall 48 of the stator chamber 45. By means of the coupling member 36 the external eccentric 11 is adjusted relative to the inner eccentric 8 such that the eccentric drive has its greatest eccentricity. The coupling member 36 has been moved the farthest in the X direction. Moreover, the coupling member 36 has been rotated by the positive-locking connection 41, 42; 43, 44 together with the stator 6. When the shaft 2 in the position according to FIG. 3*c* is rotated about its axis 47, the drive element 13 is moved in the X–Y plane as a result of the large eccentricity by a correspondingly large amount so that the pistons 14 resting against the planar surfaces 15 to 17 of the drive element 13 carry out their maximum stroke.

In the manner disclosed, the eccentricity of the eccentric drive 8, 11 can be continuously adjusted by means of the adjusting device 7 so that the stroke of the pistons 14 can be controlled correspondingly finely and can be adjusted to the desired requirements.

Since the drive element 13 in operation is moved back and forth in the X–Y plane, a moment of friction occurs between the planar surfaces 15 to 17 of the drive element 13 and the corresponding contact surfaces of the piston 14 which moment of friction is exerted by the eccentrics 8, 11 onto the drive element 13. The pistons 14 are moved by their stroke movement only in the stroke direction while the surfaces 15 to 17 of the drive element 13 carry out displacement movements relative to the pistons 14 when the drive element 13 moves in a translatory fashion back and forth in the X–Y plane.

In order to compensate this moment of friction, the drive element 13 is supported by the coupling member 21 by means of the arms 23, 24 on the guides 25, 26 connected to the housing. The FIGS. 2*a* to 2*d* show different positions of the drive element 13 and of the coupling member 21 when the shaft 2 is rotated about its axis 47. The drive element 13 and the coupling member 21 connected thereto are moved in the X–Y plane as a function of the adjusted eccentricity of the eccentric drive 8, 11 . The guides 25, 26 connected to the housing prevent that the coupling member 21 is rotated about its axis. The coupling member 21 is only translatorily moved in the X–Y plane, as can be seen when comparing FIGS. 2*a* to 2*d*. The guiding action is realized via the arms 23, 24 and the guides 25, 26 fastened to the housing as well as via the guides 32, 33 of the coupling member 21 and the corresponding counter guide parts 34, 35 of the drive element 13. The housing-connected guides 25, 26 compensate the moments of friction which are exerted by the pistons 14 onto the drive element 13 by their translatory movement.

Based on the position according to FIG. 2*a*, the shaft 2 is rotated in clockwise direction. In accordance with the adjusted eccentricity, the drive element 13, which is arranged on the external eccentric 11, is moved translatorily in the X–Y plane to the left, wherein the drive element 13 is guided with its counter guide parts 34, 35 by the guides 32, 33 of the coupling member 21. The coupling member 21, in turn, is guided by its arms 23, 24 in the guides 25, 26 of the housing 1.

In the position according to FIG. 2*c* the shaft 2 has been rotated by a further 90°. In comparison to the position according to FIG. 2*b*, the connecting member 21 has been moved in the downward direction.

FIG. 2*d* shows a position which results when the shaft 2 is rotated further by 90° in the clockwise direction. Now the drive element 13 has been moved farthest to the right. The coupling member 21, in comparison to the position according to FIG. 2*c*, has been moved upwardly again.

The course of movement described with the aid of FIGS. 2*a* to 2*d* shows that the coupling member 21 and the drive element 13 are not rotated but are moved translatorily in the X–Y plane.

By means of the eccentric drive 8, 11, the stroke of the piston 14 can be continuously adjusted between zero and a maximum value. The adjusting device 7 serves as the actuation element with which the position of the two eccentrics 8, 11 relative to one another can be adjusted. For this purpose, in the manner described above, a relative rotation between the stator 6 and the rotor 4 is carried out. Since the rotor 4 is connected fixedly with the shaft 2 and the external eccentric 11 is coupled by means of the coupling member 36 with the stator 6, the rotation of the shaft 2 causes the inner eccentric 8 to be rotated relative to the outer eccentric 11. In this way, it is possible to adjust finally and continuously the eccentricity of the eccentric drive 8, 11. According to this eccentricity, the drive element 13 positioned on the external eccentric 11 is translatorily moved in a radial plane (X–Y plane) of the shaft 2 when the shaft 2 is driven in rotation. According to the eccentricity, the stroke of the pistons 14 resting on the drive element 13 is adjusted. The pump has a very compact configuration and is comprised of simple components so that the pump operates flawlessly over a long period of use.

While specific embodiments of the invention have been shown and described in detail to illustrate the inventive principles, it will be understood that the invention may be embodied otherwise without departing from such principles.

What is claimed is:

1. A pump for conveying a liquid, said pump comprising:

a housing (1);

a shaft (2) rotatably supported in said housing (1);

an eccentric drive (8, 11) arranged on said shaft (2) in said housing (1);

at least one drive element (13) configured to be driven by said eccentric drive (8, 11);

said shaft (2) configured to adjust an eccentricity of said eccentric drive (8, 11);

wherein said drive element (13) is configured to be adjusted according to the eccentricity of said eccentric drive (8, 11) by a translatory movement in a direction transverse to said shaft (2);

at least one piston (14) for conveying the liquid;

wherein said drive element (13) has at least one contact surface (15–17) acting on said at least one piston (14).

2. The pump according to claim 1, wherein said eccentric drive (8, 11) comprises an inner eccentric (8) and an external eccentric (11) supported on said inner eccentric (8).

3. The pump according to claim 2, wherein said inner eccentric (8) is a monolithic part of said shaft (2).

4. The pump according to claim 2, wherein said drive element (13) is supported on said external eccentric (11).

5. The pump according to claim 4, wherein said drive element (13) surrounds said external eccentric (11).

6. The pump according to claim 5, wherein said external eccentric (11) surrounds said inner eccentric (8).

7. A pump for conveying a liquid, said pump comprising:

a housing (1);

a shaft (2) rotatably supported in said housing (1);

an eccentric drive (8, 11) arranged on said shaft (2) in said housing (1);

at least one drive element (13) configured to be driven by said eccentric drive (8, 11);

said shaft (2) configured to adjust an eccentricity of said eccentric drive (8, 11);

wherein said drive element (13) is configured according to the eccentricity of said eccentric drive (8, 11) by a translatory movement in a direction transverse to said shaft (2);

at least one piston (14) for conveying the liquid and acted on by said drive element (13);

wherein said drive element (13) is supported on said housing (1) to prevent rotation of said drive element (13) with said shaft (2).

8. The pump according to claim 7, wherein said drive element (13) has a first coupling member (21) and is connected to said housing (1) with said first coupling member (21).

9. The pump according to claim 8, wherein said first coupling member (21) is penetrated by said shaft (2).

10. The pump according to claim 8, wherein said first coupling member (21) is configured to be moveable by a translatory movement in a direction transverse in a plane positioned transversely to said shaft (2).

11. The pump according to claim 8, wherein said housing (1) has at least one guide (25, 26) and wherein said first coupling member (21) has at least one counter guide part (23, 24), wherein said at least one counter guide part (23, 24) is guided in said at least one guide (25, 26) of said housing (1).

12. The pump according to claim 11, wherein said first coupling member (21) is radially guided relative to said shaft (2).

13. The pump according to claim 11, wherein said housing (1) has two of said guides (25, 26) positioned diametrically opposite one another, wherein said first coupling member (21) has two of said counter guide parts (23, 24), wherein each one of said two guides (25, 26) receives one of said two counter guide parts (23, 24).

14. The pump according to claim 11, wherein said first coupling member (21) comprises at least one guide (32, 33) and wherein said drive element (13) comprises at least one counter guide part (34, 35), wherein said at least one counter guide part (34, 35) of said drive element (13) is guided in said at least one guide (32, 33) of said first coupling member (21).

15. The pump according to claim 14, wherein said drive element (13) is radially guided relative to said shaft (2).

16. The pump according to claim 14, wherein said first coupling member (21) has two of said guides (32, 33) positioned diametrically opposite one another, wherein said drive element (13) has two of said counter guide parts (34, 35), and wherein each one of said two guides (32, 33) receives one of said two counter guide parts (34, 35).

17. The pump according to claim 14, wherein said at least one guide (32, 33) of said first coupling member (21) extends perpendicularly to said at least one guide (25, 26) of said housing (1).

18. The pump according to claim 8, further comprising an adjusting device (7) coupled to said eccentric drive (8, 11).

19. The pump according to claim 18, wherein said adjusting device (7) comprises at least one adjusting element (4) fixedly connected to said shaft (2).

20. The pump according to claim 19, wherein said adjusting element (4) is configured to be hydraulically adjusted.

21. The pump according to claim 19, wherein said adjusting device (7) comprises a rotor (4) and a stator (6), wherein said at least one adjusting element is said rotor (4).

22. The pump according to claim 21, wherein said eccentric drive (8, 11) has a second coupling member (36) and is coupled with said second coupling member (36) to said adjusting device (7).

23. The pump according to claim 22, wherein said second coupling member (36) is configured to be radially adjusted relative to said shaft (2).

24. The pump according to claim 23, wherein said second coupling member (36) has at least two guides (37, 38; 41, 42) angularly spaced from one another, wherein said external eccentric (11) and said stator (6) have counter guide parts (39, 40; 43, 44), and wherein said counter guide parts (39, 40; 43, 44) are guided in said at least two guides (37, 38; 41, 42) of said second coupling member (21).

25. The pump according to claim 24, wherein said at least two guides (37, 38; 41, 42) of said second coupling member (26) are positioned at a right angle to one another.

26. The pump according to claim 24, wherein said at least two guides (37, 38; 41, 42) of said second coupling member (36) are arranged in pairs and positioned diametrically opposite one another.

27. The pump according to claim 22, wherein said second coupling member (36) is penetrated by said shaft (2).

* * * * *